US009810038B2

(12) United States Patent
Cocker, III

(10) Patent No.: US 9,810,038 B2
(45) Date of Patent: Nov. 7, 2017

(54) BACK PRESSURE VALVE

(71) Applicant: Cameron International Corporation, Houston, TX (US)

(72) Inventor: John Joseph Cocker, III, Houston, TX (US)

(73) Assignee: Cameron International Corporation, Houston, TX (US)

( * ) Notice: Subject to any disclaimer, the term of this patent is extended or adjusted under 35 U.S.C. 154(b) by 253 days.

(21) Appl. No.: 14/586,357

(22) Filed: Dec. 30, 2014

(65) Prior Publication Data

US 2016/0186527 A1 Jun. 30, 2016

(51) Int. Cl.

| | |
|---|---|
| ***E21B 34/02*** | (2006.01) |
| ***E21B 33/03*** | (2006.01) |
| ***E21B 23/01*** | (2006.01) |

(52) U.S. Cl.

CPC ..... *E21B 34/02* (2013.01); *E21B 23/01* (2013.01); *E21B 33/03* (2013.01)

(58) Field of Classification Search

None

See application file for complete search history.

(56) References Cited

U.S. PATENT DOCUMENTS 2,358,677 A * 9/1944 Yancey ..... E21B 33/03 137/515.7
3,250,331 A * 5/1966 Boyle ..... E21B 23/02 166/133
4,058,162 A * 11/1977 Smith ..... E21B 23/02 166/124
8,616,289 B2 * 12/2013 Nguyen ..... E21B 23/02 166/373
8,701,756 B2 * 4/2014 Nguyen ..... E21B 23/01 166/150
2006/0185841 A1 * 8/2006 Swagerty ..... E21B 43/26 166/88.1
2009/0000781 A1 * 1/2009 Bolding ..... E21B 33/068 166/90.1
2010/0258319 A1 * 10/2010 Nguyen ..... E21B 23/02 166/373
2011/0011598 A1 * 1/2011 Nguyen ..... E21B 23/01 166/386

FOREIGN PATENT DOCUMENTS

| | | | |
|---|---|---|---|
| WO | 2009/067298 | A1 | 5/2009 |
| WO | 2009/120446 | A2 | 10/2009 |
| WO | 2009/126420 | A1 | 10/2009 |

OTHER PUBLICATIONS

PCT International Search Report and Written Opinion; Application No. PCT/US2015/064560; Dated Apr. 4, 2016; 14 pages.

* cited by examiner

*Primary Examiner* — Shane Bomar
(74) *Attorney, Agent, or Firm* — Fletcher Yoder, P.C.

(57) ABSTRACT

Embodiments of the present disclosure are directed towards a back pressure valve configured to mount in a mineral extraction system. The back pressure valve includes a body comprising a venting port coaxial with a longitudinal axis of the body, a plunger configured to be in sealing engagement with the body to seal the venting port, and a lock ring disposed about the body, wherein the lock ring is configured to automatically expand radially upon removal of a tool.

20 Claims, 4 Drawing Sheets

BACK PRESSURE VALVE

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system often includes a tubing hanger or casing hanger that is disposed within the wellhead assembly and configured to secure tubing and casing suspended in the well bore. In addition, the hanger generally regulates pressures and provides a path for hydraulic control fluid, chemical injections, or the like to be passed through the wellhead and into the well bore. In such a system, a back pressure valve is often disposed in a central bore of the hanger. The back pressure valve plugs the central bore of the hanger to block pressures of the well bore from manifesting through the wellhead. During some operations, the back pressure valve is removed to provide access to regions below the hanger, such as the well bore. Unfortunately, many back pressure valves are threaded (i.e., rotated) into the hanger, which can cause complications.

BRIEF DESCRIPTION OF THE DRAWINGS

Various features, aspects, and advantages of the present disclosure will become better understood when the following detailed description is read with reference to the accompanying figure, wherein.

DETAILED DESCRIPTION OF SPECIFIC EMBODIMENTS

Figure 1:
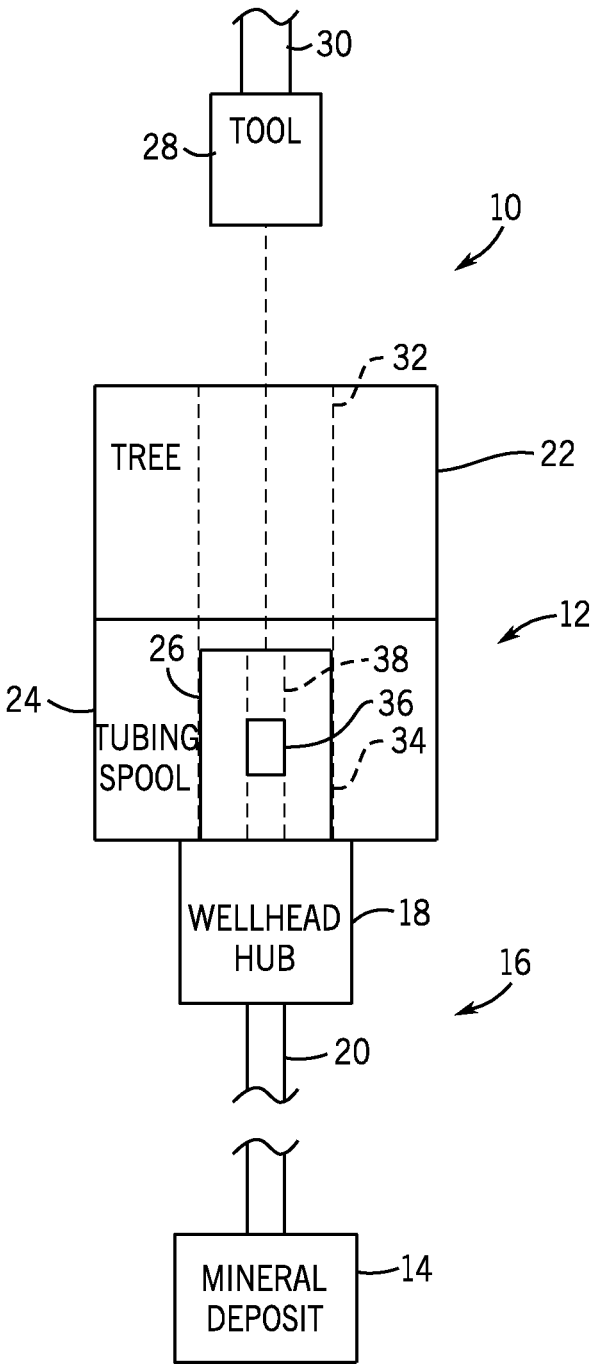
FIG. 1 is a block diagram that illustrates a mineral extraction system in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present disclosure include a system and method that addresses one or more of the above-mentioned inadequacies of conventional sealing systems and methods. As explained in greater detail below, the disclosed embodiments include a back pressure valve that can be installed linearly (e.g., in an axial direction without rotation) into a bore of a wellhead component, such as a hanger or tubing head adapter. More specifically, the back pressure valve is installed and landed within the bore via a linear force provided by a tool. Once the back pressure valve is landed within the wellhead component, the tool may disengage with the back pressure valve. As the tool is disengaging and being removed from the back pressure valve landed within the wellhead component, a snap or lock ring of the back pressure valve automatically expands and engages with a lock ring recess of the bore of the wellhead component. With the lock ring engaged with the lock ring recess, the back pressure valve is secured in place within the bore of the wellhead component. The back pressure valve may be disengaged and removed from the bore of the wellhead component by compressing the lock ring. Specifically, the tool may be lowered within the bore of the wellhead component, and the tool may compress the lock ring radially inward, thereby disengaging the lock ring from the lock ring recess of the bore. When the lock ring is disengaged from the bore, the tool may remove the back pressure valve (e.g., via a linear force) from the bore of the wellhead component. As discussed in detail below, the disclosed back pressure valve enables an increase in the size of the bore of the wellhead component, while enabling higher pressure containment of the back pressure valve.

FIG. 1 is a block diagram that illustrates a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 12 to the well 16. For example, the wellhead 12 includes a connector that is coupled to a complementary connector of the wellhead hub 18. In one embodiment, the wellhead hub 18 includes a DWHC (Deep Water High Capacity) hub, and the wellhead 12 includes a complementary collet connector (e.g., a DWHC connector).

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well bore 20 (down-hole). In the illustrated embodiment, the wellhead 12 includes what is colloquially referred to as a christmas tree 22 (hereinafter, a tree), a tubing spool 24, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a retrievable running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing spool 24 provides a base for the wellhead 24 and/or an intermediate connection between the wellhead hub 18 and the tree 22. Typically, the tubing spool 24 is one of many components in a modular subsea or surface mineral extraction system 10 that is run from an offshore vessel or surface system. The tubing spool 24 includes the tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. As will be appreciated, pressures in the bores 20 and 34 may manifest through the wellhead 12 if not regulated. A back pressure valve 36 may be seated and locked in the hanger bore 38 to regulate the pressure. Similar back pressure valves 36 may be used throughout mineral extraction systems 10 to regulate fluid pressures and flows.

In the context of the hanger 26, the back pressure valve 36 can be installed into the hanger 26 before the hanger 26 is installed in the wellhead 12, or may be installed into the hanger 26 after the hanger 26 has been installed in the wellhead 12 (e.g., landed in the tubing spool bore 34). In the latter case, the hanger 26 may be run down and installed into the wellhead 12 (e.g., surface or subsea wellhead), followed by the installation of the back pressure valve 36. Present embodiments of the back pressure valve 36 are landed within the hanger 26 via a linear force (e.g., axial translation without rotation of the back pressure valve 36). For example, the tool 28 may run the back pressure valve 36 into the hanger 26 and land the back pressure valve 36 against a shoulder of the hanger 26. Thereafter, the tool 28 may be decoupled and removed from the back pressure valve 36. As the tool 28 is removed from the back pressure valve 36, the tool 28 releases a lock or snap ring (e.g., in a compressed state) of the back pressure valve 36, such that the lock or snap ring may automatically expand radially and engage with a lock ring recess of the hanger 26. In this manner, the back pressure valve 36 is axially retained within the hanger 26. The absence of a threaded connection to secure the back pressure valve 36 within the hanger 26 enables an increase in the size of the hanger bore 38 because forming threads in the hanger bore 38 generally reduces the size of the hanger bore 38. As a result, the hanger 26 and the back pressure valve 36 may be able to withstand higher pressures. Additionally, formation and preparation of the hanger bore 38 may be simplified by not forming threads for back pressure valve 36 retention.

Figure 2:
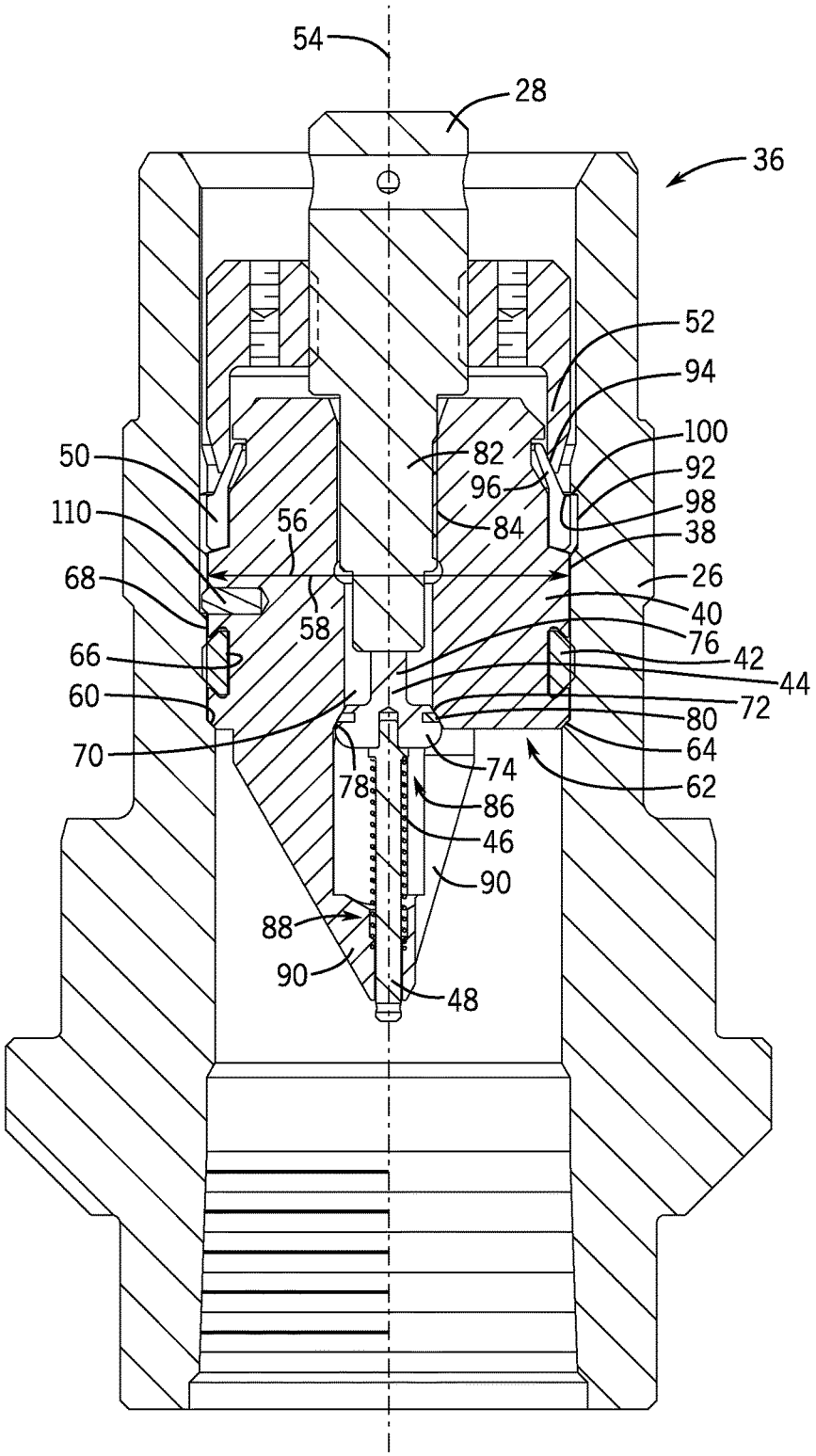
FIG. 2 is a cross-sectional side view of a back pressure valve in a landed position with a lock ring of the back pressure valve in a compressed state.

FIG. 2 illustrates a cross section of an exemplary embodiment of the back pressure valve 36 (e.g., one-way check valve). In the illustrated embodiment, the back pressure valve 36 includes a body 40, a body seal 42, a plunger 44, a plunger spring 46 disposed about a biasing stem 48, and a lock ring 50 (e.g., a C-ring). The back pressure valve 36 is shown in a landed position within the hanger 26. Additionally, the lock ring 50 is shown as held in a radially compressed state by a compression sleeve 52 of the tool 28. Specifically, when the tool 28 is coupled to the back pressure valve 36, the compression sleeve 52 of the tool 28 extends axially over the lock ring 50 and compresses the lock ring 50 radially inward to enable axial translation (e.g., running) of the back pressure valve 36 in the hanger bore 38. In certain embodiments, the back pressure valve 36 may be a type H valve.

The body 40 generally includes a shape that is similar to the contour of the hanger bore 38. In the illustrated embodiment, the body 40 includes a cylindrical shape about a longitudinal axis 54, wherein an outer diameter 56 of the body 40 is approximately the same as (or slightly less than) an inner diameter 58 of the hanger bore 38. Such a shape enables the body 40 to slide axially into the hanger bore 38. In the illustrated embodiment, a chamfered surface 60 of the body 40 extends about the circumference of the body 40 at an axial end 62 of the back pressure valve 36. When the back pressure valve 36 is set in the hanger bore 38, the chamfered surface 60 may contact a complementary feature (e.g., a load shoulder 64) in the hanger bore 38. Accordingly, the body 40 can be lowered into the hanger bore 38 until the chamfered surface 60 contacts the complementary feature in the hanger bore 38 to enable proper positioning of the body 40 in the hanger bore 38. In other words, the profile of the body 40 (e.g., the chamfered surface 60) may ensure the back pressure valve 36 is not inadvertently inserted too far axially into the hanger bore 38.

The body seal 42 (e.g., annular seal) is located about the external diameter of the body 40. More particularly, the body seal 42 is positioned radially between the body 40 and the hanger bore 38. In the illustrated embodiment, the body seal 42 is nested in a body seal groove 66 (e.g., annular groove) in an external face 68 of the body 40. When installed into the hanger bore 38, the body seal 42 provides a fluid seal between the body 40 and the walls of the hanger bore 38. The body seal 42 may include an elastomeric seal, metallic seal, a metal end cap seal, or any combination thereof. For example, in certain embodiments the body seal 42 includes an S-seal, a T-seal, a dovetail seal, or another type of annular seal. Additionally, in the illustrated embodiment, the body seal 42 is positioned axially below the lock ring 50 when the back pressure valve 36 is positioned within the hanger 26.

The body 40 also includes a venting port 70 that extends completely through the body 40 along the axis 54. In operation, the venting port 70 enables fluid to pass through the body 40 as the back pressure valve 36 is installed into the hanger bore 38. Such an arrangement may be advantageous to enable pressure on either side of the back pressure valve 36 to equalize. Equalizing the pressure may enable the back pressure valve 36 to be installed without a significant buildup of pressure that would impart a significantly higher force on one side of the back pressure valve 36, thus, requiring an offsetting force during installation. The venting port 70 is generally closed to regulate (e.g., block) the pressure of the hanger bore 38. For example, the plunger 44 is mated to a sealing surface 72 of the venting port 70. In the illustrated embodiment, the sealing surface 72 includes a chamfer having a profile that is complementary to a profile of the plunger 44. As is discussed in greater detail below, the plunger 44 may be urged axially into a first position that includes mating the plunger 44 against the sealing surface 72 to seal the hanger bore 38 (e.g., a closed position), or may be urged axially to a second position that enables fluid to flow through the venting port 70 (e.g., an open position). The illustrated embodiment depicts the plunger 44 spring biased in a closed position.

The plunger 44 is disposed external to the venting port 70 along the axis 54. The plunger 44 may be urged in either axial direction along the axis 54 between the open and closed positions. As illustrated, the plunger 44 includes the biasing stem 48, a sealing head or bell 74, and an integral stem 76. The biasing stem 68 extends downward from the bell 74 along the axis 54. The bell 74 includes a shape and profile conducive to mating with the sealing surface 72 of the venting port 70. For example, the bell 74 includes a chamfer 78 that is complementary to the chamfer of the sealing surface 72. Further, the plunger 44 includes a plunger seal 80 (e.g., annular seal) disposed along the face of the chamfer 78 of the bell 74. The plunger seal 80 may include an elastomeric seal in one embodiment. Urging the plunger 44 into the closed position provides a fluid seal between the plunger 44 and the body 40, wherein the fluid seal blocks fluid from passing completely through the venting port 70.

The integral stem 76 includes a protrusion that extends axially upward from the bell 74 along the axis 54. When the plunger 44 is in the closed position, the integral stem 76 extends into the venting port 70 of the body 40. When the tool 28 is coupled to the back pressure valve 36, the integral stem 76 can be depressed to urge the plunger 44 axially into the open position by a central portion 82 of the tool 28. Specifically, the central portion 82 of the tool 28 is coupled to an inner diameter 84 of the tool 28 (e.g., a diameter of the venting port 70) via a threaded engagement. When the tool 28 is coupled to the back pressure valve 36, the central portion 82 of the tool 28 depresses the integral stem 76 of the plunger 44 downward to disengage the bell 74 from the sealing surface 72 of the body 40, thereby opening the back pressure valve 36. As will be appreciated, this may enable pressure on either side of the back pressure valve 36 to equalize when the back pressure valve 36 is installed within the hanger 26. Decoupling (e.g., unthreading) the tool 28 from the back pressure valve 36 will disengage the central portion 82 of the tool 28 from the integral stem 76, thereby enabling the plunger 44 to return to the closed position shown in FIG. 2.

The plunger 44 is biased to the closed position by the spring 46, or similar biasing mechanism. In the illustrated embodiment, the spring 46 is a coil spring that is disposed about the exterior of, and is coaxial with, the biasing stem 48. A first end 86 of the spring 46 is retained near the bell 74 of the plunger 44. A second end 88 of the spring 46 is retained by support fins 90 of the back pressure valve 36. The support fins 90 extend axially downward from the body 40 to support the biasing stem 48 and retain the spring 46. As the bell 74 is urged axially into the open position (e.g., by the central portion 82 of the tool 28), the spring 46 is compressed between the bell 74 and the support fins 90, thereby generating a restoring force urging the spring 46 and the plunger 44 axially into the closed position as shown in FIG. 2. When the tool 28 is not coupled to the back pressure valve 36, the spring 46 biases the plunger 44 to remain in the closed position to seal pressure within the hanger 26.

As mentioned above, the back pressure valve 36 includes the lock ring 50, which is configured to retain (e.g., axially retain) the back pressure valve 36 within the hanger bore 38 of the hanger 26. Specifically, the lock ring 50 is configured to engage with a lock ring recess 92 formed in the inner diameter 58 of the hanger bore 38. The lock ring 50 and the lock ring recess 92 may have similar or complementary contours or geometries to enable locking engagement between the two. Specifically, the lock ring 50 and the lock ring recess 92 have mating contours (e.g., tapered surfaces) that engage on both upper and lower surfaces to block axial movement in both upward and downward axial directions. The lock ring 50 is shown in FIG. 2 in a radially compressed state. The lock ring 50 is held in the radially compressed state by the compression sleeve 52 of the tool 28 when the tool 28 is coupled to the back pressure valve 36. As a result, the back pressure valve 36 may be axially translated (e.g., installed or removed) within the hanger 26 because the lock ring 50 is not engaged with the lock ring recess 92 when the lock ring 50 is held in the radially compressed state.

When the tool 28 is decoupled from the back pressure valve 36 (e.g., via unthreading the central portion 82 from the venting port 70), the compression sleeve 52 will translate axially upward. As a result, an angled surface 94 of the compression sleeve 52 will translated along an angled portion 96 of the lock ring 50. Eventually, the compression sleeve 52 will lift axially and become decoupled from the lock ring 50, thereby enabling (upon release) the lock ring 50 to automatically expand radially outward and engage with the lock ring recess 92 of the hanger bore 38. The back pressure valve 36 includes an anti-rotation pin 110, which may engage with the hanger bore 38, to block rotation of the back pressure valve 36 within the hanger bore 38 while the tool 28 is unthreaded from the back pressure valve 36. When the lock ring 50 has expanded radially to engage with the lock ring recess 92, an axial load shoulder 98 of the lock ring 50 engages with an axial load shoulder 100 of the lock ring recess 92. As will be appreciated, the respective sizes of the axial load shoulders 98 and 100 may be selected based on a desired pressure retaining capability of the back pressure valve 36. For example, the respective sizes of the axial load shoulders 98 and 100 may be increased to increase the pressure retaining capability of the back pressure valve 36.

To remove the back pressure valve 36 from the hanger 26, the tool 28 may be run into the hanger 38, and the central portion 82 of the tool 28 may be coupled to the body 40 of the back pressure valve 36 via the threaded connection described above. As similarly described above, the anti-rotation pin 110 blocks rotation of the back pressure valve 36 within the hanger bore 38 when the tool 28 is threaded to the back pressure valve 36. As the central portion 82 is coupled to the body 40, the compression sleeve 52 of the tool 28 is also translated axially downward. The angled surface 94 of the compression sleeve 52 will contact and engage with the angled portion 96 of the lock ring 50. As the compression sleeve 52 is further translated axially downward, the engagement of the angled surface 94 and the angled portion 96 will enable radial compression of the lock ring 50. As the lock ring 50 is radially compressed, the lock ring 50 will become disengaged from the lock ring recess 92, thereby enabling axial translation of the back pressure valve 36 within the hanger bore 38 again.

As will be appreciated, the back pressure valve 36 described above is installed (e.g., landed) within the hanger 26 via linear translation. In other words, the back pressure valve 36 is not installed via rotation because the back pressure valve 36 is not threaded into the hanger bore 38. Instead, the back pressure valve 36 is retained via the lock ring 50, which is configured to automatically expand and engage with the lock ring recess 92 of the hanger bore 38 when the tool 28 is removed from the back pressure valve 36 (e.g., upon release of the lock ring 50 from the tool 28). The lack of threads formed in the hanger bore 38 enables an increase in the size of the diameter 58 of the hanger bore 38. Indeed, it will be appreciated that formation of threads within the hanger bore 38 (e.g., for retention of back pressure valves therein) generally decreases the size of the hanger bore 38, while increasing the amount of preparation required when forming the hanger bore 38. Moreover, an increase in the size of the hanger bore 38 may increase pressure retaining capability of the hanger 26 and/or the back pressure valve 36. The inclusion of the lock ring 50 with the back pressure valve 36 also simplifies the landing and securing of the back pressure valve 36 within the hanger bore 38 because mere axial translation of the back pressure valve 36 during installation of the bore 38 may be simpler than rotating and threading a back pressure valve within the bore 38. Furthermore, while the embodiments discussed above are generally directed towards the back pressure valve 36, other embodiments may include other valves (e.g., two way check valves) that have the automatically expanding lock ring 50.

Figure 3:
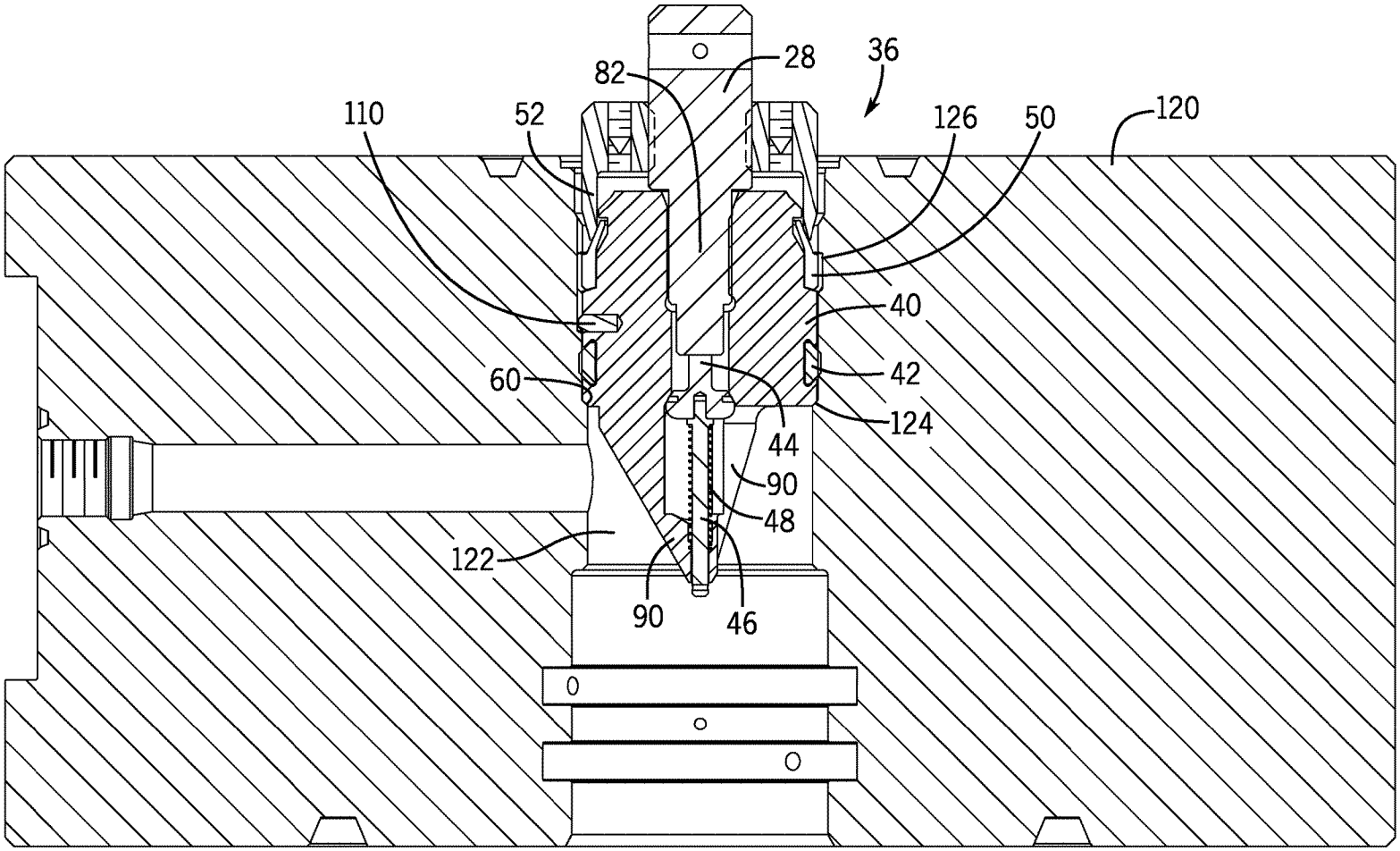
FIG. 3 is a cross-sectional side view of a back pressure valve in a landed position with a lock ring of the back pressure valve in a compressed state.

Additionally, the disclosed back pressure valve 36 has been discussed in the context of securement within the hanger 26. However, in other embodiments, the back pressure valve 36 having the automatically expanding lock ring 50 may be configured for securement within other wellhead components. For example, FIG. 3 illustrates the back pressure valve 36 positioned within an abandonment cap 120, which may be secured on top of the wellhead hub 18 or the tree 22. The illustrated embodiment includes similar elements and element numbers as the embodiment described with respect to FIG. 2.

The abandonment cap 120 has a central bore 122 that is plugged by the back pressure valve 36. As similarly described with respect to the hanger 26 of FIG. 2, the central bore 122 has a load shoulder 124 that engages with the chamfered surface 60 of the body 40 of the back pressure valve 36 to enable landing of the back pressure valve 36 within the central bore 122. Additionally, the central bore 122 has a lock ring recess 126 formed therein that is configured to engage with the lock ring 50 of the back pressure valve 36 and retain the back pressure valve 36 in place within the central bore 122. As will be appreciated, the lock ring recess 126 has features similar to those described above with respect to the lock ring recess 92 of the hanger 26.

Figure 4:
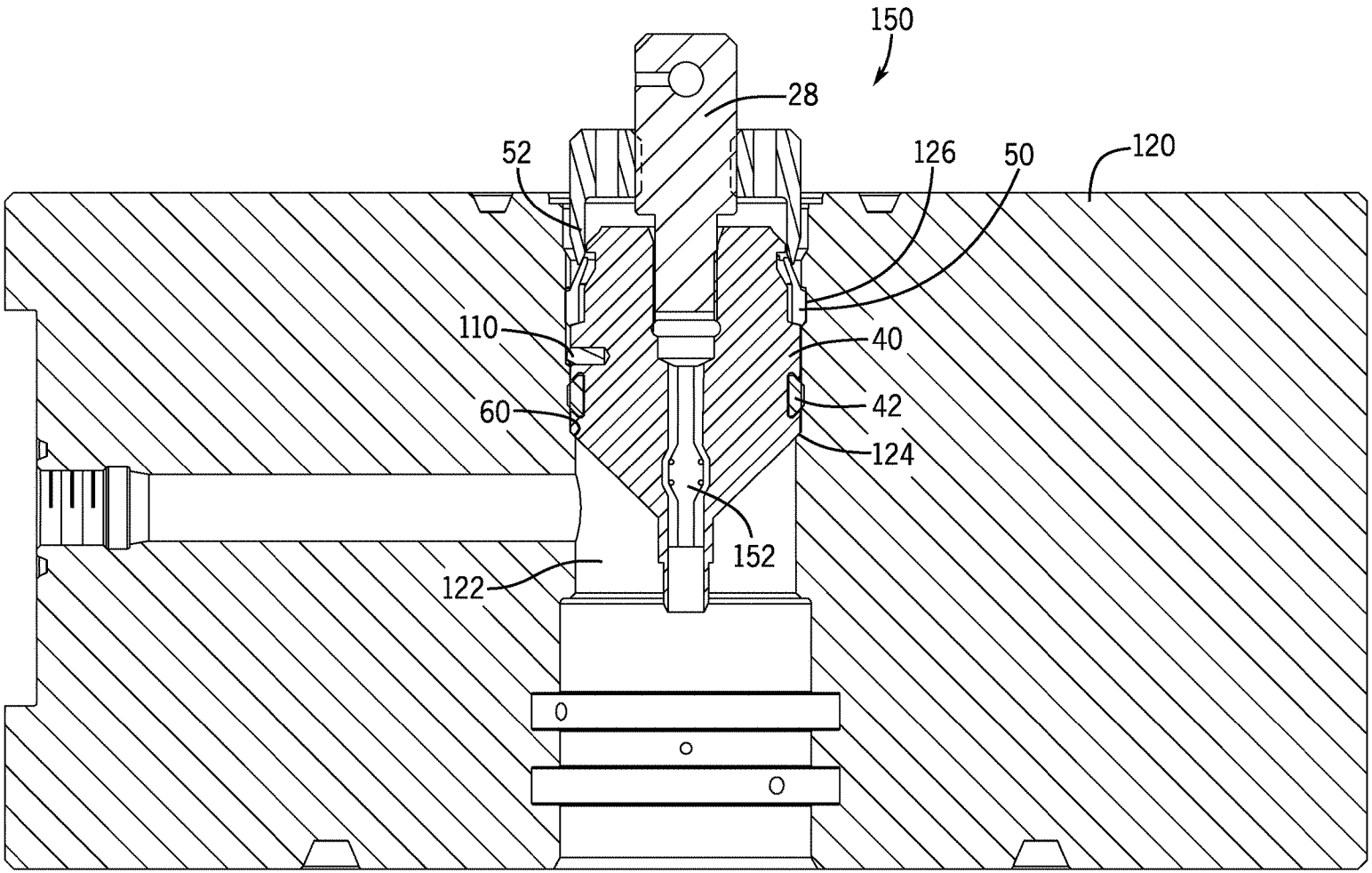
FIG. 4 is a cross-sectional side view of a back pressure valve in a landed position with a lock ring of the back pressure valve in an expanded state.

FIG. 4 illustrates another embodiment of the abandonment cap 120 having a two-way check valve 150 instead of the back pressure valve 36. The two-way check valve 150 includes similar elements and element numbers as the back pressure valve 36 described above. For example, the two-way check valve 150 includes the body 40, body seal 42, and automatically expanding lock ring 50. However, instead of the plunger 44 with the plunger spring 46 disposed about the biasing stem 48, the two-way check valve 150 includes a two-way check valve member 152 disposed within the body 42. As will be appreciated, the two-way check valve member 152 is configured to enable pressure equalization on both sides of the two-way check valve 150.

Additionally, in the illustrated embodiment, the tool 28 is shown as partially decoupled from the two-way check valve 150. More specifically, the compression sleeve 52 is shown as axially offset and decoupled from the lock ring 50. As such, the lock ring 50 has automatically expanded and is shown in an expanded state. In the expanded state, the lock ring 50 is engaged with the lock ring recess 126 of the abandonment cap 120. As a result, the two-way check valve 150 is secured within the central bore 122 of the abandonment cap 120.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a back pressure valve configured to mount in a mineral extraction system, wherein the back pressure valve comprises:

a body comprising a venting port coaxial with a longitudinal central axis of the body;

a plunger configured to be in sealing engagement with the body to seal the venting port; and a lock ring disposed about the body, wherein the lock ring is configured to automatically expand radially upon removal of a tool.

2. The system of claim 1, comprising the tool, wherein the tool is configured to radially compress the lock ring when the tool is coupled to the body of the back pressure valve.

3. The system of claim 2, wherein the tool comprises a central portion configured to threadingly engage with the venting port of the body.

4. The system of claim 1, wherein the back pressure valve comprises a seal disposed about the body of the back pressure valve.

5. The system of claim 4, wherein the seal comprises a T-seal, a dovetail seal, an annular seal, a combination thereof.

6. The system of claim 4, wherein the seal is disposed axially below the lock ring when the back pressure valve is mounted in the mineral extraction system.

7. The system of claim 1, wherein the system comprises a tubing hanger, the tubing hanger comprises a hanger bore having a lock ring recess, and the lock ring is configured to engage with the lock ring recess when the lock ring is expanded.

8. The system of claim 1, comprising the tool, wherein the tool comprises a retrievable running tool configured to land the back pressure valve within the mineral extraction system via linear, non-rotational translation.

9. A method, comprising:

coupling a retrievable tool to a back pressure valve, wherein the back pressure valve comprises a plunger configured to create a first sealing interface with a venting port of the back pressure valve, wherein the venting port is coaxial with a longitudinal central axis of the back pressure valve;

landing the back pressure valve within a mineral extraction system component via linear translation of the retrievable tool and the back pressure valve; and automatically radially expanding a lock ring of the back pressure valve upon removal of the retrievable tool from the back pressure valve.

10. The method of claim 9, wherein coupling the retrievable tool to the back pressure valve comprises threading a central portion of the retrievable tool into the venting port of the back pressure valve.

11. The method of claim 9, wherein landing the back pressure valve within the mineral extraction system component via linear translation of the retrievable tool comprises landing the back pressure valve within a hanger bore of a hanger of the mineral extraction system.

12. The method of claim 11, comprising creating a second sealing interface between the hanger bore and the back pressure valve with a seal disposed about a body of the back pressure valve, wherein the seal comprises a T-seal, a dovetail seal, or an annular seal.

13. The method of claim 9, comprising biasing the plunger of the back pressure valve toward a closed position with a spring.

14. The method of claim 9, wherein coupling the retrievable tool to the back pressure valve comprises radially compressing the lock ring of the back pressure valve into a compressed position with the retrievable tool.

15. The method of claim 14, wherein compressing the lock ring of the back pressure valve into the compressed position with the retrievable tool comprises translating an angled surface of a compression sleeve of the retrievable tool along an angled portion of the lock ring.

16. A system, comprising:

a mineral extraction system component;

a back pressure valve configured to be disposed within the mineral extraction system component, comprising:

a body comprising a venting port, wherein the venting port is coaxial with a longitudinal central axis of the body;

a plunger configured to be in sealing engagement with the body to seal the venting port; and a lock ring disposed about the body; and a retrievable tool configured to couple to the back pressure valve and linearly translate the back pressure valve into a landed position within the mineral extraction system component, wherein the lock ring is configured to automatically expand radially upon removal of the retrievable tool from the back pressure valve.

17. The system of claim 16, wherein the mineral extraction system component comprises a tubing hanger, a casing hanger, an abandonment cap, or any combination thereof.

18. The system of claim 16, wherein the mineral extraction system component comprises a bore, and the bore comprises a lock ring recess configured to receive the lock ring upon radial expansion of the lock ring.

19. The system of claim 16, wherein the back pressure valve comprises a seal disposed axially beneath the lock ring when the back pressure valve is disposed within the mineral extraction system component, wherein the seal comprises a T-seal, a dovetail seal, an annular seal, or a combination thereof.

20. The system of claim 16, wherein the back pressure valve comprises a spring configured to bias the plunger to be in sealing engagement with the body.

* * * * *